US007839980B2

(12) United States Patent
Lu et al.

(10) Patent No.: US 7,839,980 B2
(45) Date of Patent: Nov. 23, 2010

(54) X-RAY TUBE COOLING APPARATUS

(75) Inventors: Qing K. Lu, Aurora, IL (US); Xiaopo Ma, Aurora, IL (US); Kevin C. Kraft, Bolingbrook, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 333 days.

(21) Appl. No.: 11/570,978

(22) PCT Filed: Jun. 7, 2005

(86) PCT No.: PCT/IB2005/051859

§ 371 (c)(1),
(2), (4) Date: Aug. 25, 2008

(87) PCT Pub. No.: WO2006/003533

PCT Pub. Date: Jan. 12, 2006

(65) Prior Publication Data

US 2008/0310596 A1 Dec. 18, 2008

Related U.S. Application Data

(60) Provisional application No. 60/584,205, filed on Jun. 30, 2004.

(51) Int. Cl.
*H01J 35/10* (2006.01)

(52) U.S. Cl. ..... 378/141; 378/200

(58) Field of Classification Search ..... 378/130, 378/140, 141, 199, 200
See application file for complete search history.

(56) References Cited

U.S. PATENT DOCUMENTS

| | | | | |
|---|---|---|---|---|
| 4,369,517 | A | 1/1983 | Ozawa | |
| 6,400,799 | B1 * | 6/2002 | Andrews | 378/141 |
| 6,529,579 | B1 | 3/2003 | Richardson | |
| 7,186,022 | B2 * | 3/2007 | Charles et al. | 378/200 |

FOREIGN PATENT DOCUMENTS

| | | | |
|---|---|---|---|
| JP | 57162248 | A | 10/1982 |
| JP | 58216346 | A | 12/1983 |
| JP | 60136138 | A | 7/1985 |
| JP | 07262943 | A | 10/1995 |
| WO | WO 03/065772 | A2 * | 8/2003 |

* cited by examiner

*Primary Examiner*—Jurie Yun

(57) ABSTRACT

A cooling apparatus (10) for X-ray tube inserts (14) is provided. The apparatus comprises a flow director (20) that is configured to direct at least a portion of a flow of a coolant toward a window (30) of an X-ray tube insert. The flow director may incorporate a flow sleeve (208) of a plurality of nozzles (88).

23 Claims, 4 Drawing Sheets

X-RAY TUBE COOLING APPARATUS

The disclosed embodiments of a cooling apparatus and methods for use relate to the field of X-ray tube manufacture and operation. Specifically, the embodiments and methods disclosed relate to mechanisms and methods of cooling X-ray tubes while such tubes are in operation.

X-ray tubes are generally comprised of an outer housing and an insert. The insert typically includes the components necessary to produce X-rays. When X-ray tubes need to be replaced, ordinarily only the insert is replaced by removing an installed insert with components that have failed and placing a new insert into the original housing.

When in use, X-ray tubes produce great amounts of heat that should be eliminated. Heat is a substantial contributor to, or direct cause of, the failure of X-ray tube insert components. Among the components susceptible to failure are those comprising, and in the vicinity of, the insert window.

Current ways of eliminating such heat include the use of a coolant that is substantially or completely transparent to X-rays. This coolant is usually a liquid or other suitable fluid. Commonly, the coolant is pumped into the tube housing at a first end to fill the housing with coolant. This results in the insert being immersed in, or surrounded by, the coolant in the housing. The coolant then absorbs heat generated by the X-ray tube or other insert components. Heated coolant is then removed from the housing at a second end and may be circulated through a heat exchanger to reduce the temperature of the coolant. After the temperature of the heated coolant is reduced, the coolant is then pumped back into the housing at the first end, forming a closed, recirculating system.

A cooling apparatus for X-ray tube inserts is provided. The apparatus comprises a flow director configured to direct at least a portion of a flow of coolant toward a window of an X-ray tube insert.

The flow director may also comprise a flow sleeve to create a generally wedge-shaped coolant flow pattern. Additionally, the flow director may comprise a plurality of nozzles, each configured to direct a portion of the flow of coolant in a generally fan-shaped spray pattern.

The flow director may comprise a plurality of nozzles, wherein a first one of the plurality of nozzles is configured to direct a first portion of the flow of coolant in a first direction, and a second one of the plurality of nozzles is configured to direct a second portion of the flow of coolant in a second direction that is different from the first direction.

The cooling apparatus may include a flow diversion unit configured to divert a portion of the flow of coolant into a coolant-containing region of an X-ray tube housing. Additionally, the apparatus may include a housing configured to receive the cooling apparatus and coolant, a cathode and an anode operatively coupled together to emit radiation and configured to be received by the housing.

A disclosed cooling apparatus for X-ray tube inserts comprises a coolant ingress region configured to receive an incoming coolant flow through a first passage; a coolant diversion region in fluid communication with the coolant ingress region to divert the flow of coolant from the coolant ingress region; and at least one flow director in fluid communication with the coolant diversion region for directing at least a portion of the coolant flow across a surface to be cooled. The apparatus may further include a plurality of flow directors, each in fluid communication with the coolant diversion region for directing at least a portion of the coolant flow across a surface to be cooled. Also, a first one of the plurality of flow directors may be configured to direct a first portion of the coolant flow in a first direction and a second one of the plurality of flow directors is configured to direct a second portion of the coolant flow in a second direction different from the first direction. The flow director may include a nozzle.

An X-ray tube insert is disclosed, comprising a cathode; an anode, operatively coupled to the cathode such that the operation of the cathode and anode produces radiation; a body member including a passage configured to receive a coolant flow through said passage; and a flow sleeve in fluid communication with the body member and configured to direct at least a portion of the coolant flow across a surface to be cooled by the coolant flow. The insert may further comprise a flow diversion unit configured to divert a portion of the flow of coolant into a coolant-containing region of an X-ray tube housing. Additionally, the insert may include a housing configured to receive the cathode, the anode, the flow sleeve, and coolant.

A method of cooling an X-ray tube is disclosed, comprising the steps of apportioning a flow of coolant; directing a first portion of the flow of coolant toward a first region of an X-ray tube apparatus to be cooled; and directing a second portion of the flow of coolant toward a second region of an X-ray tube apparatus to be cooled. The method may be practiced when the first region and the second region are not coextensive. The method may also be practiced when the first region is a region containing an X-ray tube insert window.

The method may further comprise the step of routing a coolant flow to a heat exchanger. Still farther, the method may include the step of directing a third portion of the flow of coolant toward the second region of an X-ray tube apparatus to be cooled.

A cooling apparatus for X-ray tube inserts is disclosed, comprising means for apportioning a flow of coolant; means for directing a first portion of the flow of coolant toward a first region of an X-ray tube apparatus to be cooled; and means for directing a second portion of the flow of coolant toward a second region of an X-ray tube apparatus to be cooled. The apparatus may further be where the first region and the second region are not coextensive. Additionally, the first region may be a region containing an X-ray tube insert window. Also, the apparatus may include means for directing a third portion of the flow of coolant toward the second region of an X-ray tube apparatus to be cooled.

Figure 1:
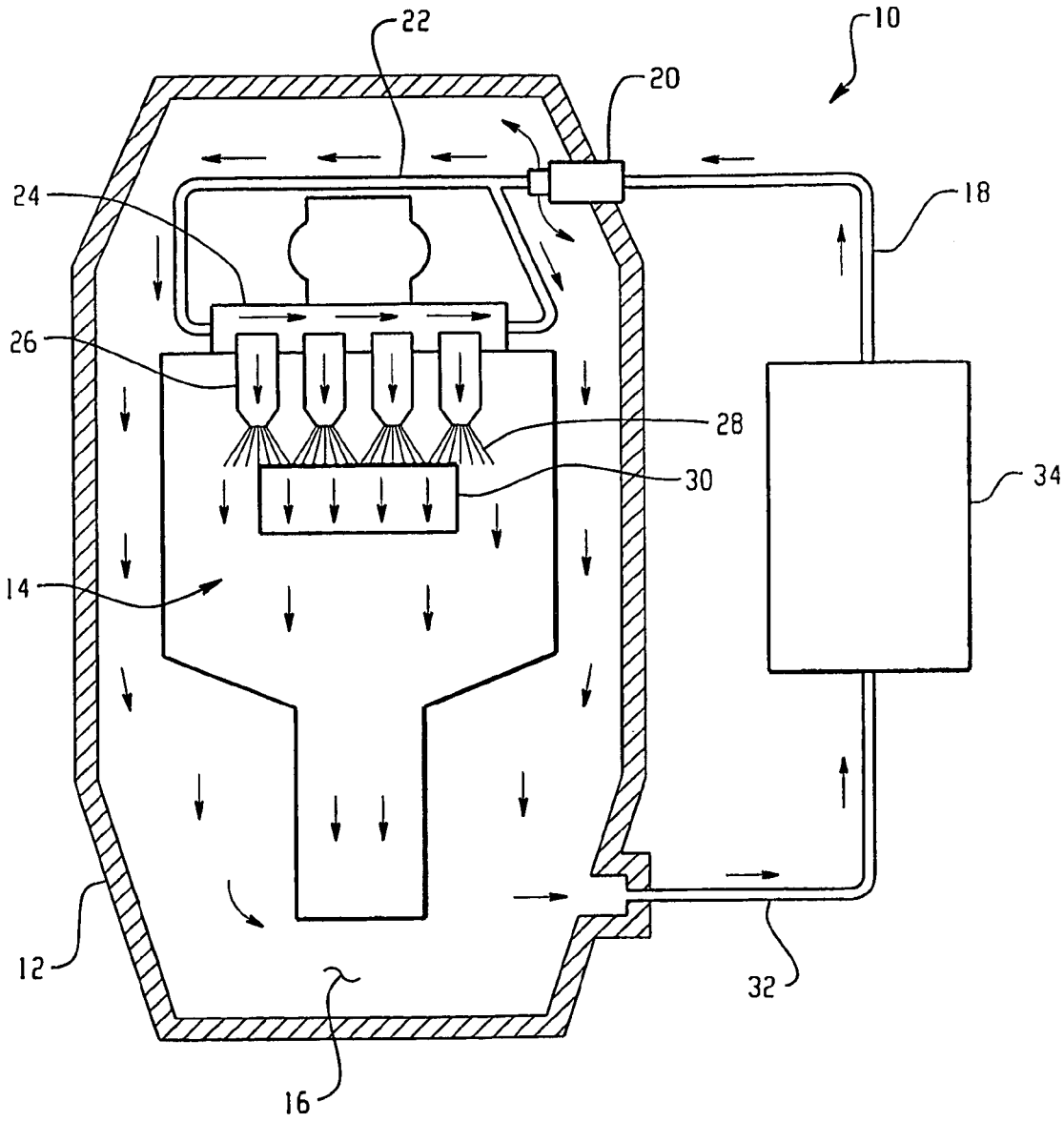
FIG. 1 is a system diagram of an X-ray tube insert window cooling system.

FIG. 1 depicts an X-ray tube cooling system 10. The cooling system 10 includes an X-ray tube housing 12. The housing 12 contains an X-ray tube insert 14 and coolant 16. An ingress coolant line 18 carries coolant 16 to a flow diverting unit 20. The flow diverting unit 20 is attached to the housing 12 and provides an ingress region for coolant to enter and fill the interior of the housing 12.

The flow diverting unit 20 is configured to divert some coolant 16 to a coolant diversion line 22 while allowing an undiverted portion of the coolant 16 to enter the interior of the housing 12. The coolant diversion line 22 carries diverted coolant to a flow director 24. The flow director 24 may include a plurality of nozzles 26. Each of the nozzles 26 directs a portion of the diverted coolant in a generally fan-shaped spray 28 over the insert window 30, where the diverted coolant commingles with undiverted coolant in the interior of the housing 12.

An egress coolant line 32 carries coolant 16 to a heat exchanger 34. The heat exchanger 34 includes a coolant pump (not pictured) that circulates coolant 16 throughout the system.

Figure 2:
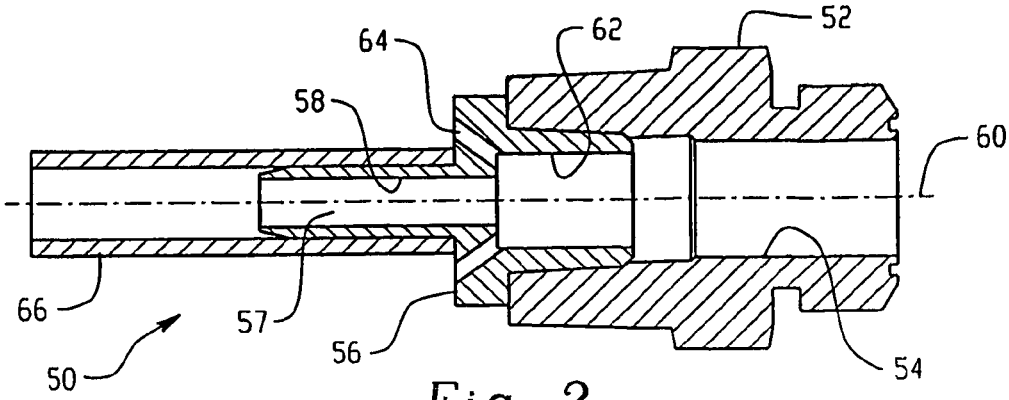
FIG. 2 is a cross-sectional view of a flow diverting unit.

FIG. 2 depicts a flow diverting unit 50 that is suitable for use as the flow diverting unit 20 depicted in FIG. 1. The flow diverting unit 50 has a body portion 52 that is generally cylindrical in shape with a center passage 54 running laterally along its length and configured to receive an incoming coolant flow. Body portion 52 is coupled to a diverter 56. The diverter 56 is also generally cylindrical in shape with a center passage 58 that runs laterally along its length and has a common axis 60 with the center passage 54 of the body portion 52.

The diverter 56 has a main coolant passage 62 that receives an incoming coolant flow from the center passage 54 of the body 52. The diverter also has a center tube 57 that is generally cylindrical in shape, shares common axis 60, and contains a portion of the center passage 58 of the diverter 56. Bypass passages 64 connect to the main coolant passage 62 and allow a portion of the coolant entering the diverter 56 to exit the flow diverting unit 56.

Coolant that does not exit the flow diverting unit 56 through a bypassing passage continues through the center passage portion of center tube 57 and exits the diverter 56, entering coolant hose 66.

Figure 3:
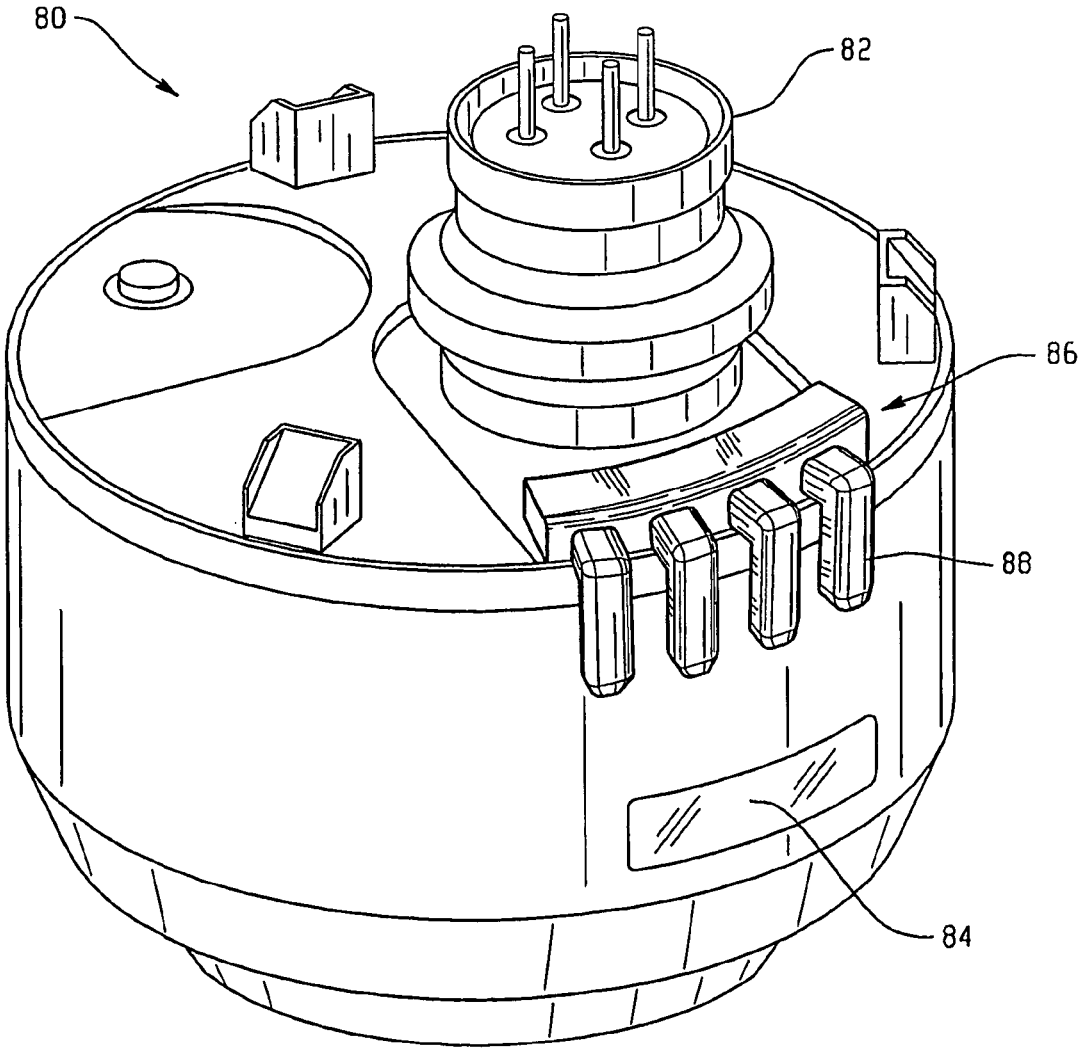
FIG. 3 is a diagram of an X-ray tube insert with a flow director attached.

FIG. 3 depicts the exterior of an X-ray insert 80. The X-ray insert 80 includes an X-ray tube 82 that produces X-rays during operation. The insert 80 also includes an X-ray window 84. Attached to X-ray insert 80 is a flow director 86. The flow director 86 includes one or more nozzles 88 to direct coolant toward and across the surface of the X-ray window 84.

Figure 4A:
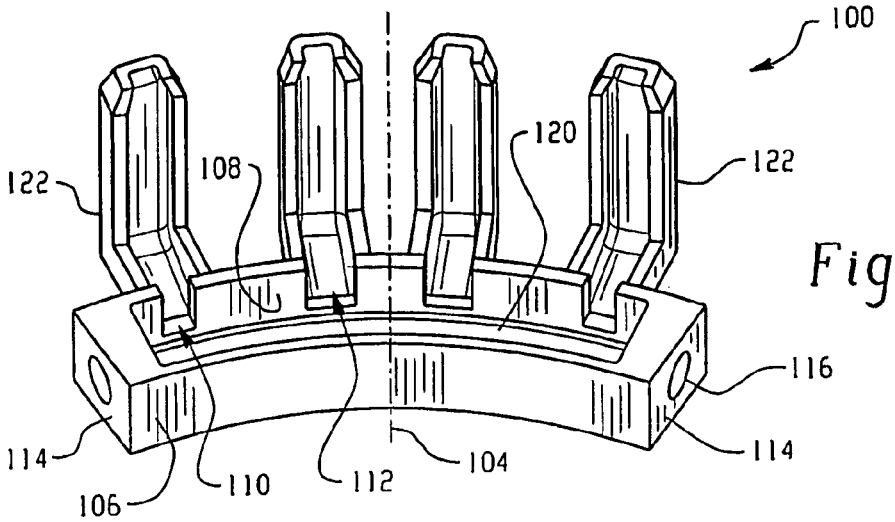
FIG. 4A is a view of the underside of a first configuration of a flow director.
Figure 4B:
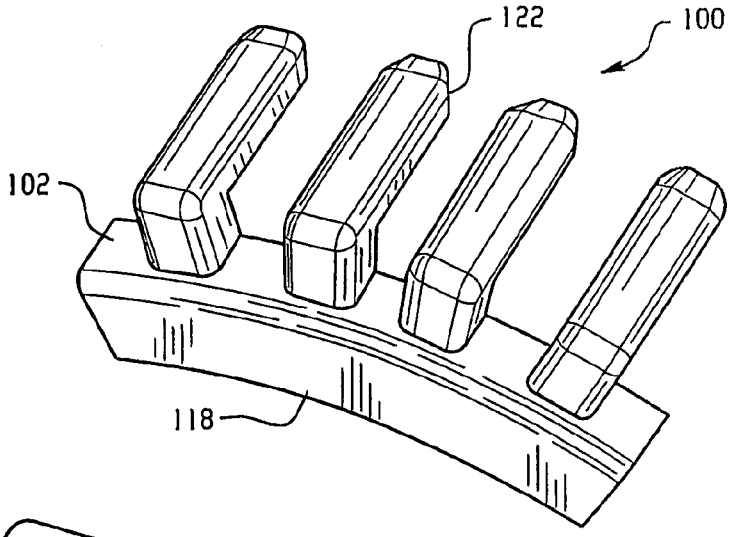
FIG. 4B is a view of the top of a first configuration of a flow director.

FIGS. 4A and 4B depict a first configuration of a flow director 100. The flow director 100 has a body 102 that is generally arc-shaped about a center line 104. The arc of body 102 is compatible with the arc of the X-ray insert with which the flow director 100 is used. The body 102 has a first wall 106 and a second wall 108 that are both generally arc-shaped. Second wall 108 contains a plurality of openings or notches that can be of different sizes such as small opening 110 and large opening 112. The body 102 also has side walls 114, each of which has an opening 116. The body 102 also has a rear wall 118. The walls 106, 108, 114, and 118 are connected to form a five-sided, box-like structure that defines a coolant passage 120.

Attached to the wall 108 of the body 102 at the area of openings 110 and 112 are a plurality of nozzles 122. Each nozzle has 2 side walls and a rear wall connected generally at right angles to form a general U-shaped formation where the U is then bent to form an angle such that the channel of the U-shape matches with the notches of wall 108 to provide a fluid communication channel between the coolant passage 120 and the nozzle 122. The end of the nozzle 122 is tapered to narrow the end of the nozzle.

The openings 116 allow the flow of coolant into the coolant passage 120. The coolant then flows through a small opening 110 or a large opening 112 and into nozzle 122. In nozzle 122, the coolant flows through the length of the nozzle and exits at the tapered end of the nozzle.

Figure 5:
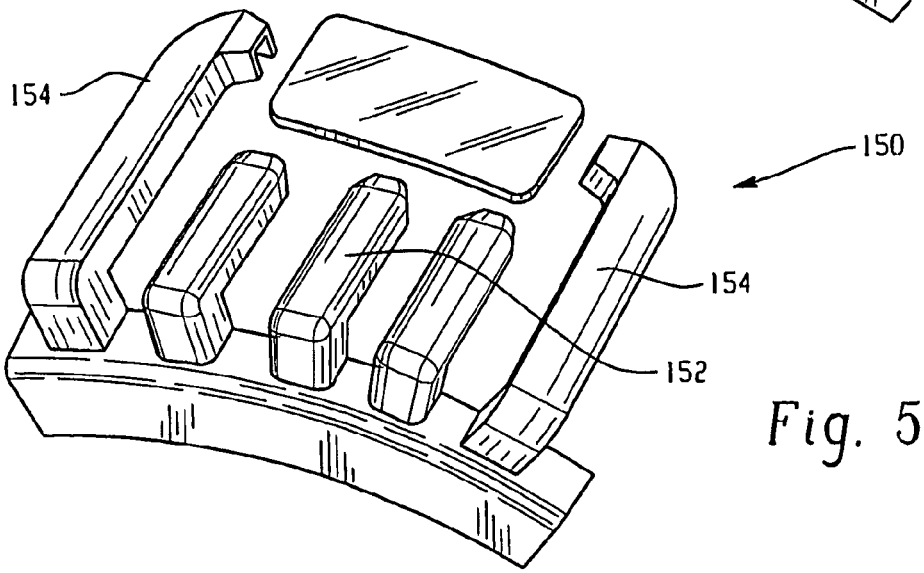
FIG. 5 is a view of the top of a second configuration of a flow director.

FIG. 5 depicts a second configuration of a flow director 150. This second configuration is similar to the first configuration, including nozzles 152 that are similar to the nozzles 122 of FIGS. 4A and 4B. Additionally, extended nozzles 154 are provided. The extended nozzles 154 are located at either end of the line of openings in the wall of the body and have been modified to bend the tapered end of the nozzle substantially 90 degrees such that the direction of flow of coolant from the extended nozzles travels substantially perpendicularly to the direction of coolant flow from nozzles 152.

Figure 6A:
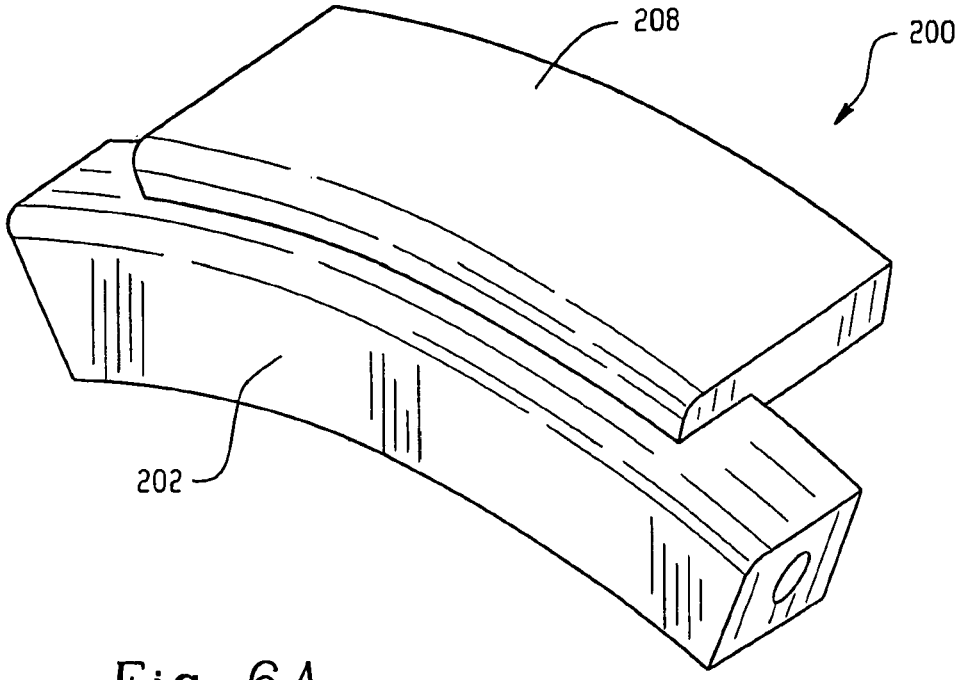
FIG. 6A is a view of the top of a third configuration of a flow director.
Figure 6B:
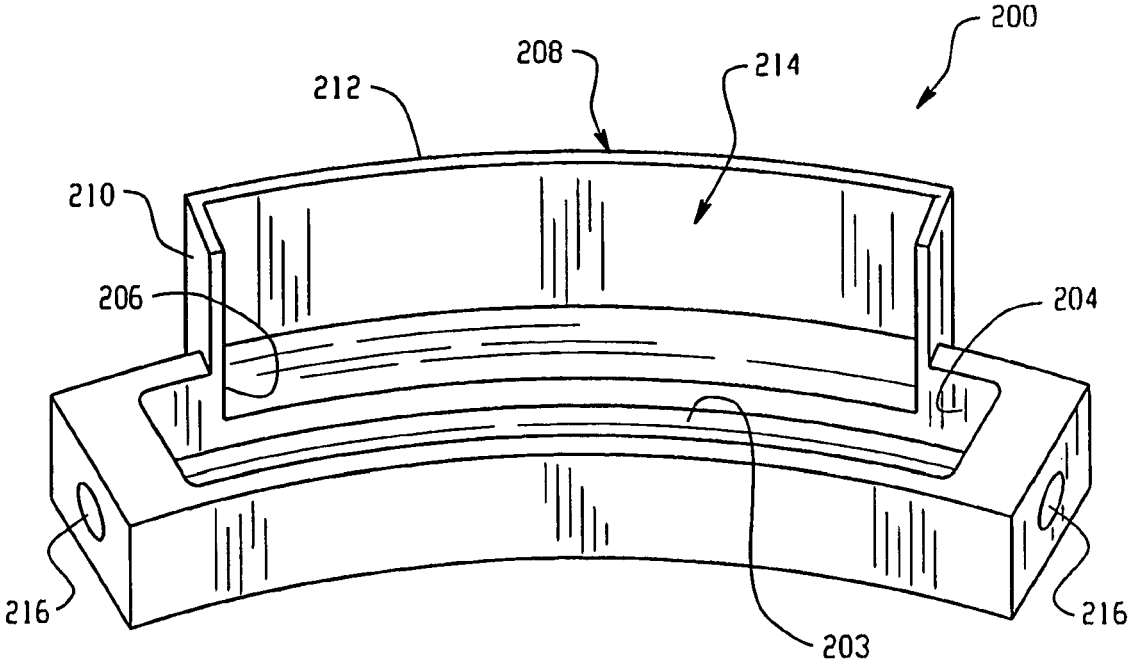
FIG. 6B is a view of the bottom of a third configuration of a flow director.

FIGS. 6A and 6B depict a third configuration of a flow director 200. The flow director 200 has a body 202 that is similar to body 102 of flow director 100 and includes a coolant passage 203. The flow director 200 has a wall 204 that corresponds to wall 108 of flow director 100. However, wall 204 contains a single notch 206 instead of a plurality of openings. The flow director 200 also has a flow sleeve 208 that is connected to the body 202 in the region of the notch 206. The flow sleeve 208 is generally arc-shaped to substantially match the arc of the body 202. The flow sleeve 208 has side walls 210 and a top wall 212. Side walls 210 and top wall 212 are connected at their edges at substantially right angles to define a coolant egress area 214. Coolant egress area 214 is in fluid communication with coolant passage 203 and coolant ingress openings 216.

Coolant flows into the coolant passage 203 of body 202 through coolant ingress openings 216. Coolant then continues to flow through notch 206 into the coolant egress area 214 of the flow sleeve 208 and exits in a generally wedge-shaped flow pattern, as opposed to the generally fan-shaped spray patterns provided by the nozzles of other configurations.

The invention disclosed herein is defined by the claims read by a person of ordinary skill in the art in light of the disclosures made in the specification. Modifications of and alterations to the materials disclosed herein will occur to others upon reading and understanding of the preceding detailed description. It is intended that the invention be construed as including all such modifications and alterations insofar as they come within the scope of the appended claims or the equivalents thereof.

The invention claimed is:

1. A cooling apparatus for an X-ray tube insert to be received within an X-ray tube housing, comprising:

a flow diversion unit configured (i) to divert a portion of a flow of coolant and (ii) to allow an undiverted portion of the flow of coolant into an interior coolant-containing region of the X-ray tube housing; and a flow director configured to direct the diverted portion of the flow of coolant toward a window of the X-ray tube insert, where the diverted portion of coolant commingles with the undiverted portion of coolant in the interior coolant-containing region of the X-ray tube housing, wherein the flow director comprises a flow sleeve, the flow sleeve including (i) an arc-shaped body having a coolant passage, (ii) a wall containing a single notch and (iii) a sleeve connected to the body in a region of the single notch, the sleeve further being arc-shaped to substantially match the arc-shape of the body, further wherein the diverted portion of the flow of coolant exits the flow sleeve in a generally wedge-shaped flow pattern.

2. The cooling apparatus of claim 1, wherein the flow director further includes a plurality of nozzles, each nozzle being configured to direct a portion of the diverted portion of the flow of coolant.

3. The cooling apparatus of claim 2, wherein a first one of the plurality of nozzles is configured to direct a portion of the diverted portion of the flow of coolant in a first direction, and a second one of the plurality of nozzles is configured to direct another portion of the diverted portion of the flow of coolant in a second direction that is different from the first direction.

4. The cooling apparatus of claim 1, wherein the flow diversion unit comprises (i) a main coolant passage for receiving an incoming coolant flow, (ii) bypass passages connected to the main coolant passage, and (iii) a center passage connected to the main coolant passage, wherein the bypass passages allow coolant entering the main coolant passage to exit the flow diversion unit into the interior coolant-containing region of the X-ray tube housing, and wherein the center passage allows coolant entering the main coolant passage to be diverted to the flow director.

5. The cooling apparatus of claim 4, further comprising the X-ray tube housing configured to receive the cooling apparatus and coolant.

6. The cooling apparatus of claim 5, further comprising a cathode and an anode operatively coupled together to emit radiation and configured to be received by the X-ray tube housing.

7. A cooling apparatus for an X-ray tube insert to be received within an X-ray tube housing, comprising:

a coolant ingress region configured to receive an incoming coolant flow through a first passage;

a coolant diversion region in fluid communication with the coolant ingress region (i) to divert a portion of the incoming flow of coolant from the coolant ingress region and (ii) to allow an undiverted portion of the incoming flow of coolant into an interior coolant-containing region of the X-ray tube housing; and at least one flow director in fluid communication with the coolant diversion region for directing the diverted portion of the incoming coolant flow across a surface to be cooled, where the diverted portion of incoming coolant flow commingles with the undiverted portion of incoming coolant flow in the interior coolant-containing region of the X-ray tube housing, wherein the at least one flow director comprises at least one flow sleeve, the flow sleeve including (i) an arc-shaped body having a coolant passage, (ii) a wall containing a single notch and (iii) a sleeve connected to the body in a region of the single notch, the sleeve further being arc-shaped to substantially match the arc-shape of the body, further wherein the diverted portion of the flow of coolant exits the flow sleeve in a generally wedge-shaped flow pattern.

8. The cooling apparatus of claim 7, wherein the at least one flow director comprises a plurality of flow directors, each flow director in fluid communication with the coolant diversion region for directing at least a portion of the diverted portion of the incoming coolant flow across the surface to be cooled.

9. The cooling apparatus of claim 8, wherein a first one of the plurality of flow directors is configured to direct a portion of the diverted portion of the incoming coolant flow in a first direction and a second one of the plurality of flow directors is configured to direct another portion of the diverted portion of the incoming coolant flow in a second direction different from the first direction.

10. The cooling apparatus of claim 8, wherein the plurality of flow directors includes at least one nozzle.

11. The cooling apparatus of claim 7, wherein the at least one flow director further includes a nozzle.

12. An X-ray tube insert to be received within an X-ray tube housing, comprising:

a cathode;

an anode, operatively coupled to the cathode such that the operation of the cathode and anode produces radiation;

a body member including a passage configured to receive a coolant flow through said passage;

a flow diversion unit configured (i) to divert a portion of the coolant flow and (ii) to allow an undiverted portion of the coolant flow into an interior coolant-containing region of the X-ray tube housing; and a flow sleeve in fluid communication with the flow diversion unit and configured to direct the diverted portion of the coolant flow across a surface of the X-ray tube insert to be cooled by the coolant flow, wherein the flow sleeve includes (i) an arc-shaped body having a coolant passage, (ii) a wall containing a single notch and (iii) a sleeve connected to the body in a region of the single notch, the sleeve further being arc-shaped to substantially match the arc-shape of the body, further wherein the diverted portion of the flow of coolant exits the flow sleeve in a generally wedge-shaped flow pattern, where the diverted portion of coolant flow commingles with the undiverted portion of coolant flow in the interior coolant-containing region of the X-ray tube housing.

13. The X-ray tube insert of claim 12, wherein the flow diversion unit comprises (i) bypass passages connected to the passage of the body member, and (ii) a center passage connected to the passage of the body member, wherein the bypass passages allow coolant entering the passage of the body member to exit the flow diversion unit into the interior coolant-containing region of the X-ray tube housing, and wherein the center passage allows coolant entering the coolant passage of the body member to be diverted to the flow sleeve.

14. The X-ray tube insert of claim 13, further comprising the X-ray tube housing, wherein the X-ray tube housing is configured to receive the cathode, the anode, the flow sleeve, and coolant.

15. A method of cooling an X-ray tube insert to be received within an X-ray tube housing, comprising the steps of:

apportioning a flow of coolant (i) to divert a portion of the coolant flow and (ii) to allow an undiverted portion of the coolant flow into an interior coolant-containing region of the X-ray tube housing;

directing a first portion of the diverted portion of the flow of coolant toward a first region of the X-ray tube insert to be cooled via a flow sleeve, wherein the flow sleeve includes (i) an arc-shaped body having a coolant passage, (ii) a wall containing a single notch and (iii) a sleeve connected to the body in a region of the single notch, the sleeve further being arc-shaped to substantially match the arc-shape of the body, further wherein the diverted portion of the flow of coolant exits the flow sleeve in a generally wedge-shaped flow pattern; and directing a second portion of the diverted portion of the flow of coolant toward a second region of the X-ray tube insert to be cooled, where the first and second portions of the diverted portion of coolant flow commingle with the undiverted portion of coolant flow in the interior coolant-containing region of the X-ray tube housing.

16. The method of claim 15, wherein the first region and the second region are not coextensive.

17. The method of claim 16, wherein the first region is a region containing an X-ray tube insert window.

18. The method of claim 17, further comprising the step of routing a coolant flow to a heat exchanger.

19. The method of claim 15, further comprising the step of directing a third portion of the diverted portion of the flow of coolant toward the second region of the X-ray tube insert to be cooled.

20. A cooling apparatus for an X-ray tube insert to be received within an X-ray tube housing, comprising:

means for apportioning a flow of coolant (i) to divert a portion of the coolant flow and (ii) to allow an undiverted portion of the coolant flow into an interior coolant-containing region of the X-ray tube housing;

means for directing a first portion of the diverted portion of the flow of coolant toward a first region of the X-ray tube insert to be cooled via a flow sleeve, wherein the flow sleeve includes (i) an arc-shaped body having a coolant passage, (ii) a wall containing a single notch and (iii) a sleeve connected to the body in a region of the single notch, the sleeve further being arc-shaped to substantially match the arc-shape of the body, further wherein the diverted portion of the flow of coolant exits the flow sleeve in a generally wedge-shaped flow pattern; and means for directing a second portion of the diverted portion of the flow of coolant toward a second region of the X-ray tube insert to be cooled, where the first and second portions of the diverted portion of coolant flow commingle with the undiverted portion of coolant flow in the interior coolant-containing region of the X-ray tube housing.

21. The cooling apparatus of claim 20, wherein the first region and the second region are not coextensive.

22. The cooling apparatus of claim 21, wherein the first region is a region containing an X-ray tube insert window.

23. The cooling apparatus of claim 21, further comprising means for directing a third portion of the diverted portion of the flow of coolant toward the second region of the X-ray tube insert to be cooled.

* * * * *